United States Patent [19]

Maurer et al.

[11] 4,326,661

[45] Apr. 27, 1982

[54] MAGAZINE FOR FEEDING HEADED FASTENERS INTO A DRIVING APPARATUS

[75] Inventors: Werner Maurer, Nuertingen; Gerhard Farian, Grossbettlingen, both of Fed. Rep. of Germany

[73] Assignee: Karl M. Reich, Maschinenfabrik GmbH, Nuertingen, Fed. Rep. of Germany

[21] Appl. No.: 140,571

[22] Filed: Apr. 14, 1980

[30] Foreign Application Priority Data

Apr. 20, 1979 [DE] Fed. Rep. of Germany ..... 2915994

[51] Int. Cl.[3] ..... B25C 5/16

[52] U.S. Cl. ..... 227/120; 206/338; 227/130

[58] Field of Search ..... 227/120, 130, 139; 221/290, 296; 206/338

[56] References Cited

U.S. PATENT DOCUMENTS

| | | | |
|---|---|---|---|
| 3,133,670 | 5/1964 | Heyer | 221/296 X |
| 3,615,049 | 10/1971 | Obergfell et al. | 227/120 X |
| 4,197,974 | 4/1980 | Morton et al. | 227/120 X |
| 4,253,598 | 3/1981 | Haytayan | 227/130 X |

*Primary Examiner*—Gil Weidenfeld
*Assistant Examiner*—Fred A. Silverberg
*Attorney, Agent, or Firm*—W. G. Fasse; D. F. Gould

[57] ABSTRACT

A magazine for fasteners with heads is made of two separate, profiled, extruded channel members of light metal or thermosetting material. The channel members are held together by a plurality of screws or releasable clips. The channel members are further spaced from each other by an exchangeable spacer rod, whereby the magazine may be adapted to fasteners of different sizes by replacing the spacer rod with another spacer rod having a different thickness and height or width. Gliding shoulders, for example of spring steel wire, for the fastener heads are arranged longitudinally on the inwardly facing side of each channel member.

6 Claims, 2 Drawing Figures

MAGAZINE FOR FEEDING HEADED FASTENERS INTO A DRIVING APPARATUS

BACKGROUND OF THE INVENTION

Figure 1:
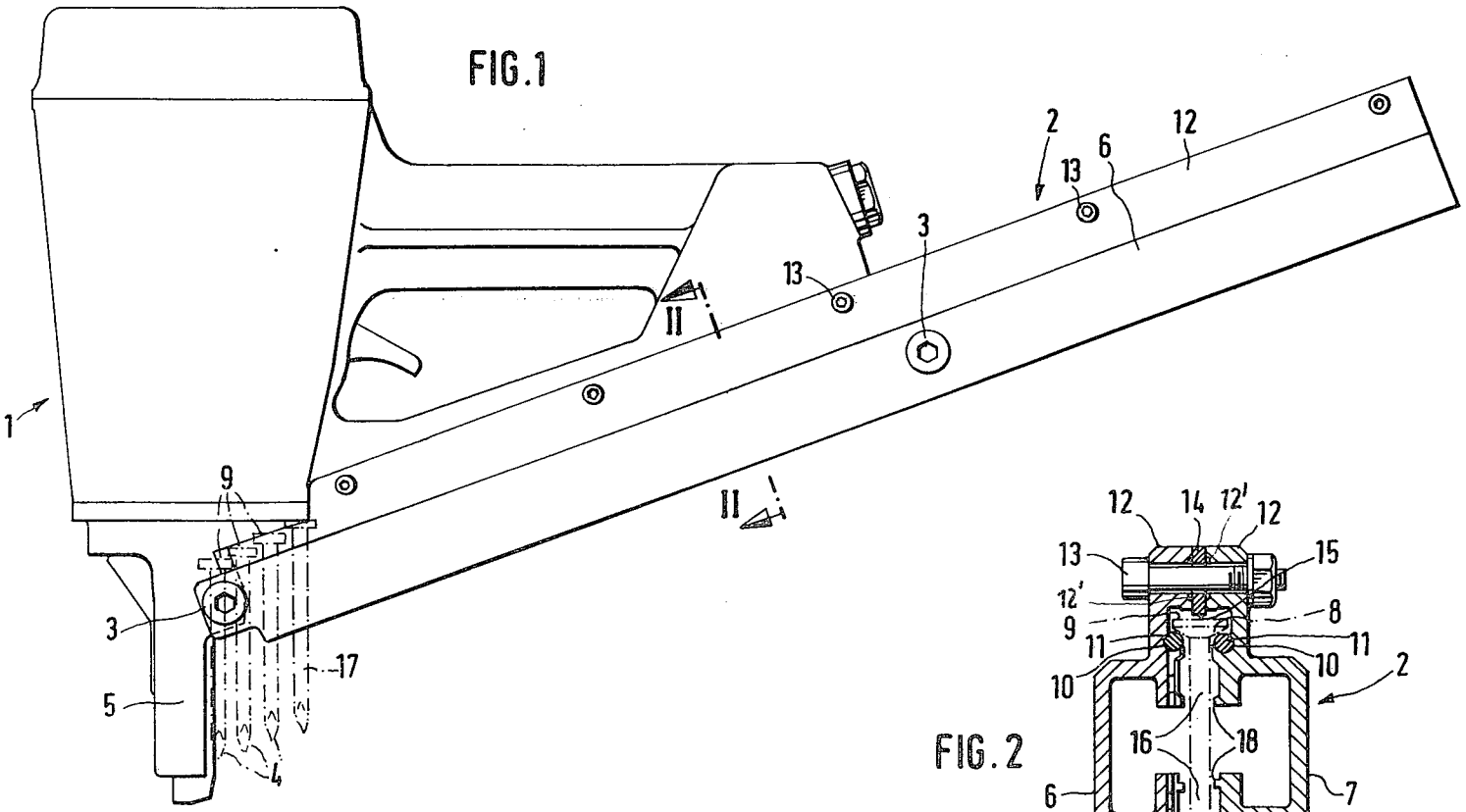

The present invention relates to a magazine for feeding headed fasteners into a driving apparatus. For this purpose the magazine is connected to the driving apparatus. Such magazines comprise two side members spaced by a spacer element. The side members are provided with supporting surfaces for the heads of the fasteners.

Such magazines take up nails, screws, screw nails, and similar fastening elements simply referred to as fasteners in the following specification. For driving or screwing the fasteners into a workpiece they are supplied to the driving mechanism which drives or screws the fasteners substantially automatically. It is known to make such magazines or the side members of these magazines from stamped or bent sheet steel, whereby these sheet steel side members are held at a fixed spacing from each other by a spacer rod and all elements are held in position by rivets.

The production of such magazines or rather of the magazine side members of sheet steel requires several working steps and is hence expensive. In order to keep the weight of the magazines within acceptable limits it is necessary that the wall thickness of the steel sheet is not excessive. However, this requirement is limited because the magazine must retain a dimensional stability so that the guide channel will not warp in operation. Such warping would interfere with the continuous feeding of the fasteners into the driving apparatus.

Further, it is desirable that such magazines accommodate fasteners of different sizes which have different diameters and different heads. Thus, heretofore it was customary to provide different magazines for different fasteners and different sizes of the same type of fastener to have respectively adapted guide chutes or grooves. Furthermore, it is desirable to make the length of such magazines as long as possible for stationary nailing machines. In this instance the stamped and bent component must also be adapted to the particular type of use.

OBJECTS OF THE INVENTION

In view of the above it is the aim of the invention to achieve the following objects singly or in combination:

- to construct a magazine for automatic fastener drivers which is inexpensive in its manufactur and which is easily adapted to different types of uses as well as to different types of fasteners and different sizes of fasteners;
- to construct the magazine so that it will retain its dimensional stability while simultaneously being relatively lightweight; and
- to construct the channel members of extruded standard sectional stock such as aluminum rails or extruded sectional stock made of thermosetting material.

SUMMARY OF THE INVENTION

According to the invention there is provided a magazine for feeding headed fasteners into a driving apparatus which comprises two separate, profiled, channel members of light metal separated by an exchangeable spacer element and provided on the inwardly facing surfaces with support elements of steel for forming support surfaces for the heads of the fasteners so that the latter may slide down the guide chute formed in the magazine.

Preferably, the side elements are formed by extrusion methods using light metal such as aluminum or thermosetting material, thereby providing the advantage that the desired length may be cut from standard stock components. The adaptations of the magazine to fasteners having different shaft diameters and different shapes of heads is accomplished according to the invention by means of an exchangeable spacer element arranged between the two side channel members. The fastener heads are supported on glide tracks formed on the inwardly facing surfaces of the channel members. These glide tracks are made of steel, preferably steel wire which together with the downwardly facing narrow edge of the spacer member define a glide chute with a very small surface area, thereby minimizing the friction between the magazine and the fasteners as the latter glide down the magazine toward the driver apparatus. Thus, a trouble-free and easy continuous supply of the fasteners into the drive is assured.

The use of light metal or dimensionally stable thermosetting material for the channel members which are preferably mirror symmetrical, relative to each other assure, with proper selection of the wall thicknesses, the required dimensional stiffness of the entire magazine while simultaneously keeping the weight of the magazine within acceptible limits.

BRIEF FIGURE DESCRIPTION

Figure 2:
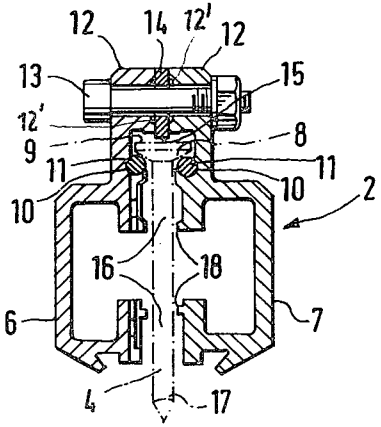

In order that the invention may be clearly understood, it will now be described, by way of example, with reference to the accompanying drawings, wherein:

FIG. 1 shows a side view of a driving apparatus equipped with a magazine according to the invention; and FIG. 2 is a sectional view along section line II—II in FIG. 1.

DETAILED DESCRIPTION OF PREFERRED EXAMPLE EMBODIMENTS AND OF THE BEST MODE OF THE INVENTION

FIG. 1 shows a driving apparatus 1, for example, an air pressure operated nail driver, to which the magazine 2 according to the invention is secured by screws 3. Fasteners 4 having shafts 17 and heads 9 are supplied to the driving apparatus 1 through the magazine 2 into the discharge channel 5 of the driver 1. These fasteners 4 may, for example, be interconnected by belts or strips of synthetic material to form a continuous strip or the fasteners may be held in the magazine 2 without any interconnections between adjacent fasteners.

FIG. 2 shows that the magazine comprises two channel members 6 and 7 which preferably have a substantially mirror symmetrical configuration relative to a central vertical plane. Preferably, the channel members 6 and 7 are cut from standard extruded light metal stock or extruded synthetic material having the necessary dimensional stability. Aluminum has been found to be suitable for the intended purpose and provides simultaneously a lighweight magazine which nevertheless assures the necessary dimensional stability.

In order to form a supporting slide surface 8 for the heads 9 of the fasteners 4, a cylindrical groove 10 is provided on each inwardly facing surface of the channel members 6 and 7. The surface 8 itself is formed for example, on steel wires 11 secured in the groove 10.

Preferably, the steel wires 11 are sections of hardened spring steel which are held in position by adhesive and/or pinching portions of the groove side wall at spaced intervals against the wire 11.

Each side or channel member 6, 7 is provided at its upper end with a connecting flange 12 which extends substantially along the entire length of each channel member and which are provided with an inwardly flat groove 12' so that the contact with the spacer 14 is between two ridges above and below the respective groove 12'. The channel members 6 and 7 are interconnected by nuts and bolts 13 which extend through the flanges 12 and through the spacer member 14 which is thus exchangeable against a spacer member of a different size with regard to its horizontal thickness and its vertical height. Preferably, the downwardly facing narrow edge 15 of the spacer 14 is rounded and polished to minimize friction between the edge 15 and the top of the heads 9.

When the channel members 6 and 7 are interconnected they form a guide chute 16 for the shafts 17 of the fasteners 4. To minimize friction it is preferable that the inwardly facing flanges of the channel members 6 and 7 are provided with guide ridges 18 extending all along the guide chute 16 and assuring a proper guiding of the shafts 17.

The present magazine is adaptable for different types and sizes of fasteners by simply exchanging the spacer rod 14 against another one which is simply accomplished by loosening the screws 13, thereby increasing or decreasing the horizontal clearing between opposing ridges 18 in accordance with the diameter of the respective fastener shaft 17.

Although the invention has been described with reference to specific example embodiments, it will be appreciated, that it is intended, to cover all modifications and equivalents within the scope of the appended claims.

What is claimed is:

1. A magazine for feeding fasteners having heads into a driving apparatus for the fasteners, comprising two separate, profiled, channel members with inwardly facing sides defining a travel path for the fasteners, means releasably connecting said channel members to each other to form the magazine, spacer means of given width exchangeably interposed between said two channel members for defining a width for said travel path, and longitudinal support means made of steel wire secured to said inwardly facing sides of said channel members for supporting the heads of said fasteners by tangential contact with the steel wire minimizing the friction of the fasteners sliding along said longitudinal steel wire support means.

2. The magazine of claim 1, wherein said separate channel members are made of extruded, sectional light metal and wherein said longitudinal steel wire support means form two fastener supporting shoulders or ridges.

3. The magazine of claim 1 or 2, wherein said longitudinal steel wire support means are made of spring steel wire.

4. The magazine of claim 1 or 2, wherein each of said channel members has an inwardly facing connecting flange having a given vertical dimension, and wherein said spacer means has a vertical dimension larger than said given vertical dimension whereby the downwardly facing edge of said spacer means forms together with said longitudinal support means a guide chute for said fastener heads.

5. The magazine of claim 4, wherein each of said inwardly facing connecting flanges has a flat groove therein to provide defined contact ridges in the respective flange.

6. The magazine of claim 1, wherein said channel members comprise inwardly facing guide ridges (18) for said fasteners.

* * * * *